US009155363B2

(12) United States Patent
Ng

(10) Patent No.: US 9,155,363 B2
(45) Date of Patent: Oct. 13, 2015

(54) METHOD OF MANUFACTURING MULTI-ELEMENT TUNGSTEN CARBIDE JEWELRY RINGS

(71) Applicant: Sangly Ng, Kowloon (HK)

(72) Inventor: Sangly Ng, Kowloon (HK)

(73) Assignee: Diamond Direct, LLC, New York, NY (US)

( * ) Notice: Subject to any disclaimer, the term of this patent is extended or adjusted under 35 U.S.C. 154(b) by 228 days.

(21) Appl. No.: 13/998,361

(22) Filed: Oct. 25, 2013

(65) Prior Publication Data

US 2015/0113809 A1 Apr. 30, 2015

(51) Int. Cl.

| | |
|---|---|
| ***A44C 27/00*** | (2006.01) |
| ***B21D 53/44*** | (2006.01) |
| ***A44C 9/00*** | (2006.01) |

(52) U.S. Cl.

CPC ..... *A44C 9/0015* (2013.01); *A44C 27/00* (2013.01); *A44C 27/002* (2013.01); *Y10T 29/49588* (2015.01); *Y10T 29/49593* (2015.01)

(58) Field of Classification Search

CPC .. A44C 9/0007; A44C 9/0015; A44C 9/0023; A44C 27/00; A44C 27/002; B21D 53/44; Y10T 29/49588; Y10T 29/49593

See application file for complete search history.

(56) References Cited

U.S. PATENT DOCUMENTS

| | | | | |
|---|---|---|---|---|
| 1,093,698 | A * | 4/1914 | Heaton | 29/896.4 |
| 1,224,193 | A * | 5/1917 | Milhening | 63/15 |
| 3,440,705 | A * | 4/1969 | Johnson | 29/894 |
| 6,062,045 | A | 5/2000 | West | |
| 6,553,667 | B1 | 4/2003 | West | |
| 6,641,640 | B1 | 11/2003 | Hesse et al. | |
| 6,928,734 | B1 | 8/2005 | West | |
| 6,990,736 | B2 | 1/2006 | West | |
| 6,993,842 | B2 | 2/2006 | West | |
| 7,032,314 | B2 | 4/2006 | West | |
| 7,076,972 | B2 | 7/2006 | West | |
| 7,761,996 | B2 | 7/2010 | West | |
| 8,061,033 | B2 | 11/2011 | West | |
| 8,258,420 | B2 * | 9/2012 | Onodera et al. | 219/69.12 |
| 2005/0005638 | A1 * | 1/2005 | Wainberg | 63/15.4 |
| 2010/0024481 | A1 * | 2/2010 | Rothstein | 63/15.7 |
| 2010/0263408 | A1 * | 10/2010 | Kim | 63/12 |
| 2014/0326022 | A1 * | 11/2014 | Tosyali et al. | 63/15.1 |

* cited by examiner

*Primary Examiner* — Alexander P Taousakis
(74) *Attorney, Agent, or Firm* — Michael A. Painter

(57) ABSTRACT

A method for manufacturing annular jewelry rings employing multiple annular elements, at least one of which is composed of tungsten carbide. All annular ring elements composed of tungsten carbide are produced directly from tungsten carbide plate. Using an electrical discharge machining apparatus employing a preformed cylindrical electrode, an aperture of predetermined diameter is drilled through a planar, tungsten carbide plate. Using a wire electric discharge machining apparatus, annular blanks are cut from the planar tungsten carbide plate, the outer surface of the annular blank being cylindrical and concentric with the inner, drilled surface of the annular blank. The inner and outer surfaces of the tungsten carbide annular blanks are cooperatively machined to allow additional annular elements composed of tungsten carbide and other materials to be integrally coupled to one another to form jewelry in the form of rings.

7 Claims, 4 Drawing Sheets

METHOD OF MANUFACTURING MULTI-ELEMENT TUNGSTEN CARBIDE JEWELRY RINGS

BACKGROUND OF THE INVENTION

1. Field of the Invention

The field of the present invention method is the manufacture of tungsten carbide rings in general and in particular the method of manufacturing multi-element tungsten carbide rings from tungsten carbide plate.

2. Prior Art

For much of recorded history, jewelry has been manufactured from soft materials such as gold, platinum and silver. The most significant characteristic of these materials is that they are soft and are easily molded or machined. The problem that exists with jewelry manufactured from soft materials is that they are easily scratched or otherwise damaged.

In recent years, jewelry in the form of rings have been manufactured from hard material such as tungsten carbide or tantalum carbide which are much harder than the precious metals traditionally used to manufacture jewelry and will thereby prevent unwarranted defacement or damage to the jewelry. The problem with such materials is that, because of their hardness, they are extremely difficult to work with in order to produce attractive jewelry designs. As a result, the only method for utilizing these hardened materials in the manufacture of jewelry was to fabricate parts from powdered metals which have been solidified into a predetermined shape for handling and which possessed the properties necessary for the finished part. The prior art discloses the use of compression molds to form the powdered metals into the predetermined shapes that would be required for the finished part. Compression molding can require pressure in the range of 5-100 tons per square inch. However, although the use of compression molds will create a solid blank of powdered metal in a predetermined form, the compacted blanks must be sintered to recrystalize the material which will provide the enhanced hardness.

The use of compression molds to form the initial ring blank and the use of a sintering process to produce the hardened material are disclosed in U.S. Pat. Nos. 8,061,033; 7,761,996 and 6,641,640. Although the combined use of compression molds to form a solid initial blank and the application of a sintering process to harden the material is well-known, the problems inherent in these processes are also well-known. A substantial disadvantage of powder metallurgical shaping processes is that the moldings are limited to comparatively simple external shapes. Another known powder metallurgical process is powder injection molding. The main problem with powder injection molding is the need to remove the binder material used in the sintering process. A further disadvantage relates specifically to the manufacture of jewelry. The need to create the initial forms of the blank in a compression mold defines the ultimate sizing of the ring. Since a manufacturer is required to produce a full range of ring sizes, use of a compression molding process would require multiple molds for each design thereby increasing the cost of manufacturing the rings.

The present invention method overcomes the disadvantages inherent in the manufacturing methods disclosed by the prior art by producing the tungsten carbide annular blanks needed to produce multi-element jewelry rings directly from finished tungsten carbide plate. The prior art limits the structure of jewelry rings to a single annular band of tungsten carbide which is then faceted to adapt the tungsten carbide band to receive ornamentation in the form of inlays or mountings for gems. The present invention provides a method whereby jewelry rings may be constructed of a plurality of annular elements, one or more of which is composed of tungsten carbide. This greatly expands the spectrum of ornamentation that can be created.

The present invention method negates the need to use the restrictive process of using compression molds to form a solid blank of powered metal in a predetermined form. The present invention method employs electrical discharge machining (EDM) to produce the tungsten carbide elements that will be used to create a jewelry ring. EDM is a controlled metal-removal process that is used to remove metal by means of electric spark erosion. In this process, an electric spark is used as the cutting tool to cut or, in effect, erode a workpiece to produce the finished part to a desired shape. The metal-removal process is performed by applying a pulsating electrical charge of a high-frequency current through an electrode to the workpiece. This process permits the removal of very tiny pieces of metal from the work piece at a controlled rate.

A limitation to the use of electrical discharge machining is that it can operate only with materials that are electrically conductive. However, since tungsten carbide is composed primarily of tungsten, it is an electrically conductive material. During the process, the workpiece and the electrode are submerged in a dielectric fluid which is used as a coolant and to flush away removed material. The present invention employs both ram EDM and wire EDM apparatus. Ram EDM uses a shape tooling electrode to facilitate the machining process which in this case is used to drill or otherwise form the interior surface of the annular blank being made from the tungsten carbide plate. When using a computerized numerically controlled plotter, wire EDM is used to cut the annular blank from the tungsten carbide plate. This will produce an annular tungsten carbide blank having the uniform thickness necessary to produce the tungsten carbide elements employed in the jewelry rings manufactured pursuant to the present invention method. The electrical discharge apparatus uses a fine metallic wire that acts as a cutting electrode to accurately cut the annular blank from the tungsten carbide plate. Once a plurality of annular blanks are cut from the tungsten carbide blank, the inner and outer surfaces of respective blanks may be machined to adapt the annular blanks to be assembled into a multi-element jewelry ring in a manner that substantially improves over the methods disclosed by the prior art to produce jewelry rings composed in whole or in part of tungsten carbide.

SUMMARY OF THE INVENTION

The present invention comprises an improved method for manufacturing multiple element jewelry rings from tungsten carbide. The jewelry rings manufactured in accordance with the present invention method include one or more annular blanks cut from solid tungsten carbide plate. Each tungsten carbide annular blank is cut from a tungsten carbide plate using an electrical discharge machining process. The EDM process may be used in two different ways, both of which are employed in the present invention method. In one form, a pre-shaped or formed electrode in the form of a tool is shaped to the form of the cavity it is to reproduce. The formed electrode is generally urged vertically downward and the reverse shape of the electrode is eroded or otherwise burned into the solid workpiece. This is the conventional form of EDM used to drill apertures in a tungsten carbide plate and is generally referred to as ram EDM. The second form of the EDM process uses a continuous-traveling wire under tension as wire electrode. The wire electrode is typically as small as the diameter of a needle and its positioning is typically controlled with the use of a computerized numerically controlled plotter. This is generally referred to as a wire EDM.

Ram EDM consists of an electrode and workpiece that are submerged in an insulating fluid. An electric spark is used to cut or erode the workpiece in a manner that takes a shape that is the reciprocal of the cutting tool or electrode. In EDM ram machining, a relatively soft graphite or metallic electrode may be used to cut hardened tungsten carbide. The EDM process produces a cavity slightly larger than the electrode.

Wire EDM utilizes a thin, single-strand metal wire that is fed through the workpiece. Both the wired electrode and the workpiece are submerged in an insulating fluid while the workpiece is being cut. Wire EDM may be used to cut plates as thick as 300 mmm from hard metals that are difficult to machine with other methods.

Jewelry rings manufactured in accordance with the present invention utilize a base annular blank composed of tungsten carbide and one or more auxiliary annular blanks composed of tungsten carbide or other material such as ceramics or stainless steel to provide contrasting colors or ornamentation to the rings. All annular blanks composed of tungsten carbide are produced from tungsten carbide plate using ram EDM and wire EDM apparatus. Using ram EDM, an electrode formed to drill a uniform cylindrical aperture in the tungsten carbide plate is used as the electrode. After the inner diameter of each tungsten carbide blank is formed, the blank is cut from the tungsten carbide plate by wire EDM. Each tungsten carbide blank is substantially cylindrical when cut from the tungsten carbide plate and the outer cylindrical surface of the annular blank is substantially concentric with the uniform inner surface produced by the ram EDM process. Annular elements composed of materials other than tungsten carbide such as ceramics or stainless steel are produced by conventional methods known to those having skill in the art.

It is an object of the present invention to produce jewelry rings that are constructed of multiple elements that are to be integrated into a finished piece. The rings utilize a base annular blank composed of tungsten carbide and one or more auxiliary annular blanks composed of tungsten carbide or other materials. The diameter of the inner cylindrical surface of the base annular blank is smaller than the diameter of the inner surface of the auxiliary annular blank or blanks. To produce auxiliary annular elements that can be assembled with the base annular blank to form a completed jewelry ring, one or more uniform cylindrical sections of the outer surface of the base annular ring are removed by machining or grinding to produce an outer diameter that is concentric with the inner diameter of the base annular blank but smaller than the unmachined portion of the base annular blank. To integrate the base and auxiliary blanks, the diameter of the machined portion of the base annular blank is substantially equal to the inner diameter of the auxiliary annular blank or blanks. The outer diameter of an unmachined section of the base annular blank is substantially equal to the outer diameter of the auxiliary blank or blanks. Jewelry rings manufactured in accordance with the present invention are assembled by positioning an auxiliary blank or blanks adjacent a machined section of the outer surface of the base annular blank and securing the auxiliary elements to the base element by conventional adhesive means.

It is therefore an object of the present invention to manufacture multi-element jewelry rings made in whole or in part of tungsten carbide.

It is another object of the present invention to produce elements for jewelry rings cut directly from a tungsten carbide plate.

It is still another object of the present invention to produce tungsten carbide elements for jewelry rings by cutting the elements from a tungsten carbide blank through the use of electrical discharge machining.

It is still yet another object of the present invention to provide a method for manufacturing tungsten carbide jewelry rings that excludes the use of compression molding to form the ring elements.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
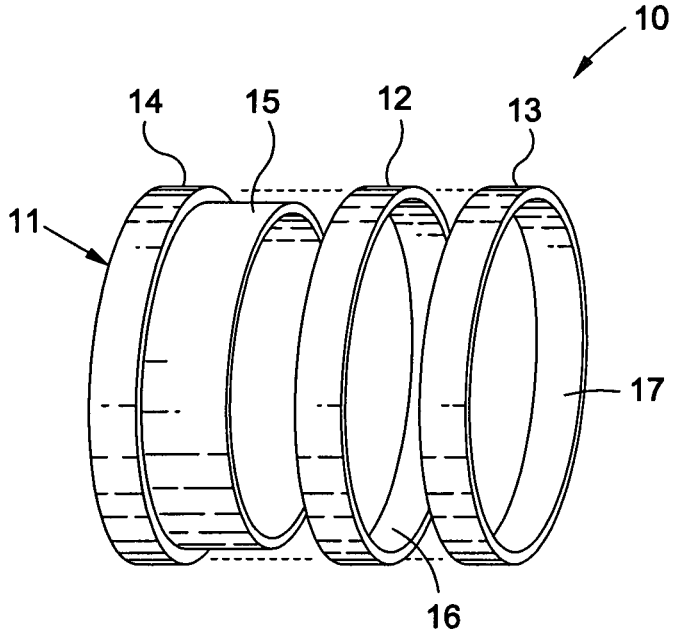
FIG. 1 is a perspective, assembly view of an exemplary jewelry ring manufactured in accordance with the present invention.
Figure 6:
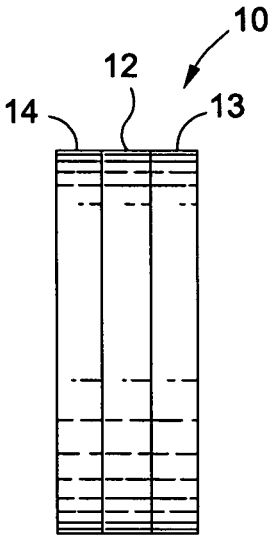
FIG. 6 is a front elevation view of an assembled jewelry ring manufactured in accordance with the present invention.
Figure 7:
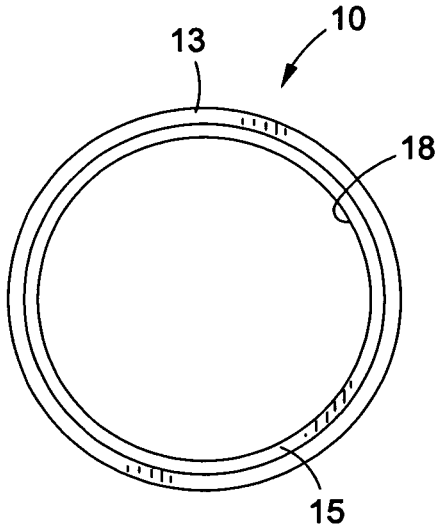
FIG. 7 is a side elevation view of an assembled jewelry ring manufactured in accordance with the present invention.

The present invention is a method for manufacturing jewelry rings that comprise multiple elements, one or more of which are composed of tungsten carbide. An understanding of the structure of jewelry rings made in accordance with the present invention can be best seen in FIGS. 1, 6 and 7, the jewelry ring being generally designated by the reference numeral 10. It will be understood by those having skill in the art that the ornamental style of jewelry rings 10 as shown in FIGS. 1, 6 and 7 is for example only and does not constitute a limitation on the present invention method. Jewelry ring 10 comprises an assembly of a base annular element 11 and auxiliary annular elements 12 and 13. In the exemplary form shown in FIGS. 1, 6 and 7, base annular element 11 has an outer surface comprising adjacent cylindrical sectors 14 and 15, the diameter of cylindrical sector 14 being greater than the diameter of cylindrical sector 15. Auxiliary annular elements 12 and 13 are cylindrical, the diameter of the inner surfaces 12 and 13 of auxiliary annular elements 12 and 13, respectively, are adapted to be slidably mounted upon and positioned adjacent cylindrical sector 15 of base annular element 11. In the exemplary structure shown in FIGS. 1, 6 and 7, the outer surfaces of cylindrical sector 14 of base annular element 11 and the outer surfaces of auxiliary annular elements 12 and 13 are co-extensive with one another. It will be understood that having the outer surfaces of auxiliary annular elements 12 and 13 co-extensive with cylindrical sector 14 of base element 11 is one of choice only and is not a limitation on the scope of the present invention. The inner cylindrical surface 18 of base annular element 11 is adapted to be sized to be worn on a finger of a user.

Figure 8:
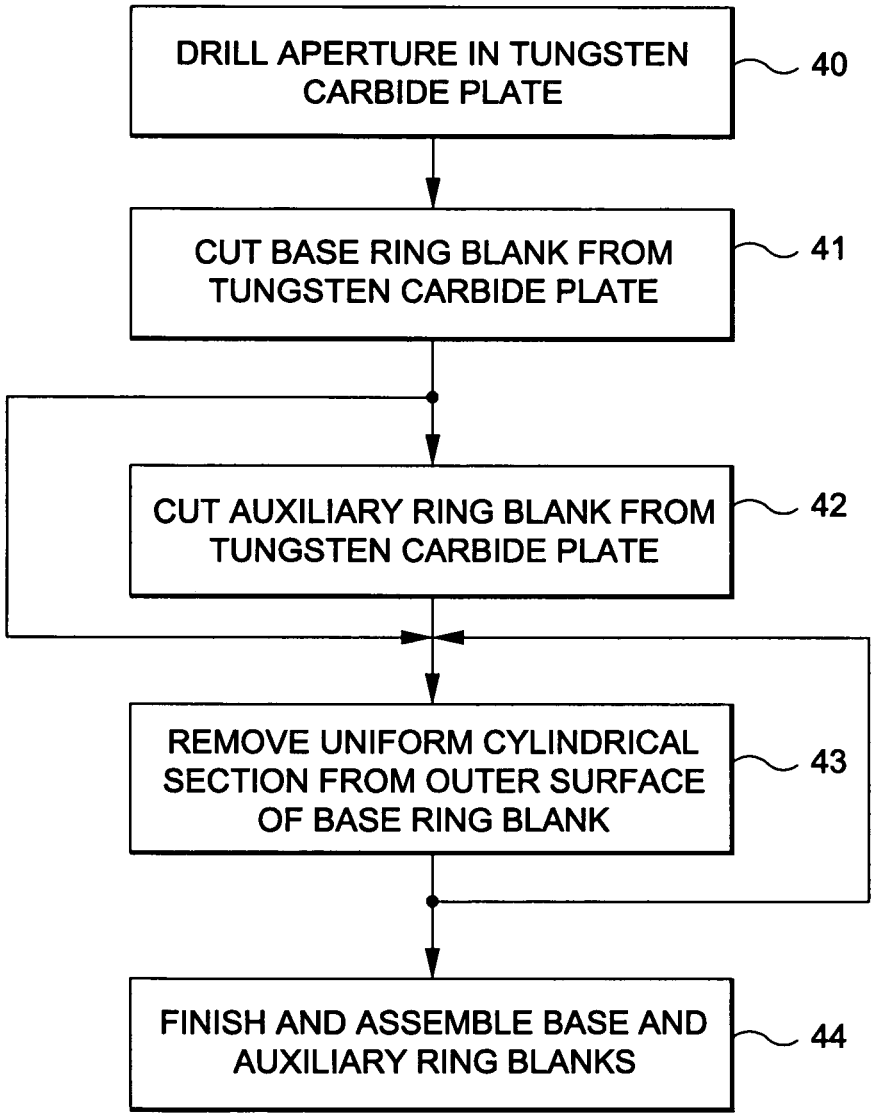
FIG. 8 is a flow chart illustrating the steps followed to manufacture jewelry rings in accordance with the present invention.

The present invention constitute a series of processing steps taken to manufacture jewelry rings that are assembled from multiple elements, the sequence of processing steps being shown in FIG. 8. In implementing the present invention, a ring manufactured thereby consists of a base element and one or more auxiliary elements. As shown in FIGS. 1, 6 and 7, these are base annular element 11 and auxiliary annular elements 12 and 13. Base annular element 11 is composed of tungsten carbide. In all rings manufactured in accordance with the present invention, for appearance the auxiliary elements 12 and 13 may be composed of tungsten carbide or be composed of other materials such as ceramics or stainless steel. The difference between the present invention method and those methods disclosed by the prior art is the manner in which tungsten carbide blanks are produced as the source of base annular element 11 and, if used, for auxiliary annular elements 12 and 13.

Figure 9:
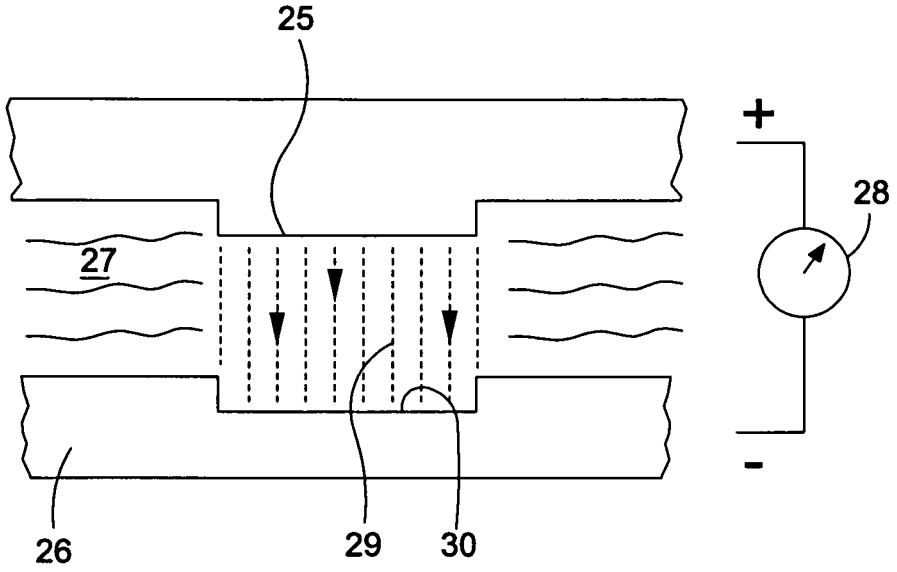
FIG. 9 is a schematic depiction of electrical discharge machining.
Figure 10:
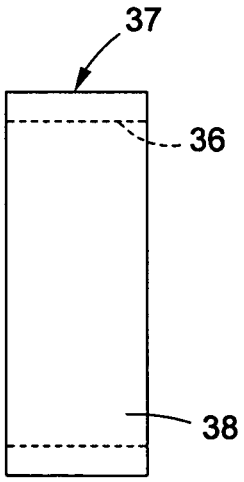
FIG. 10 is a front perspective view of the base annular blank produced in accordance with the present invention.
Figure 11:
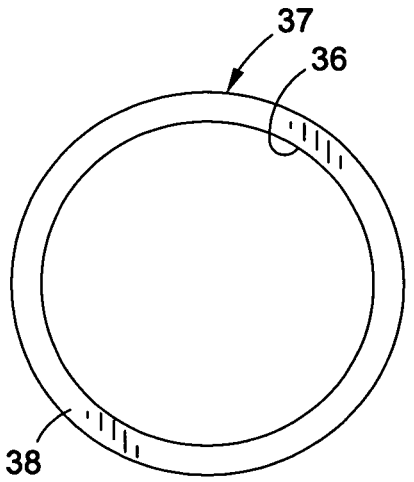
FIG. 11 is a side elevation view of the base annular blank produced in accordance with the present invention.

As opposed to creating ring blanks through the use of compression molds, tungsten carbide blanks are obtained through the electrical discharge machining of tungsten carbide plate. FIG. 9 constitutes a schematic depiction of electrical discharge machining ("EDM"). EDM is a controlled metal-removal process that is used to remove metal by means of electric spark erosion. In this process, an electric spark is used as a cutting tool to cut (or erode) the workpiece to produce the finished part in the desired shape. In EDM processing as shown in FIG. 9, a tooling electrode 25 and a workpiece 26 are submerged in an insulating or dielectric fluid 27. An electric power supply 28 is applied across cutting electrode 25 and workpiece 26. The proximity between tooling electrode 25 and workpiece 26 produces electrical discharges 29 between them. The electrical discharges 29 remove or erode material from the workpiece 26 and the pattern or shape of removed material 30 is dependent on the shape of tooling electrode 25.

There are essentially two types of electrical discharge machines which differ in the type of tooling electrode that is used. A ram EDM uses a shaped tooling electrode to facilitate the machining process. The tooling electrode is formed by conventional machining into a shape that is specific to the application it is used for and in exact reciprocal of the shape of the tool is machined into the workpiece. Ram EDM is used to drill holes through metal plates. Wire EDM uses a fine metallic wire which acts as a cutting electrode to accurately shape components from thick metal plates. When the charged wire comes into proximity with a workpiece, electrical discharges occur from the workpiece in a shape that is similar to a cutting or slicing action. Wire EDM is used to cut portions of metal plate in a pattern established by computer control.

Referring now to FIG. 6, the first manufacturing operation 40 of the present invention method requires the use of ram EDM to form a cylindrical aperture 36 through a tungsten metal plate. In one form the diameter of the aperture 36 is substantially equivalent to what is required for the diameter of the inner surface 18 of base annular element 11. If auxiliary annular elements 12 and/or 14 are to be composed of tungsten carbide, cylindrical aperture 36 will be substantially equivalent to what is required for the inner surfaces 16 or 17 of auxiliary annular elements 12 and 13, respectively. The next manufacturing operation 41 of the present invention method employs wire EDM to cut a cylindrical base ring blank 37 from the tungsten carbide plate. Cutting the cylindrical base ring blank 37 through the utilization of a computerized numerical controlled plotter, the diameter of the external surface 38 of cylindrical base ring blank 37 is concentric with aperture 36 and is substantially equal to the diameter of cylindrical sector 14 of base annular element 11. If the jewelry ring being manufactured requires that an auxiliary annular element 12 or 13 is to be composed of tungsten carbide, the next sequential manufacturing operation 42 requires that an annular blank be cut from tungsten plate using the same procedure as used to produce base ring blank 37. As stated, the only difference between a blank used as the source for base annular element 11 or a blank used as the source of auxiliary annular elements 12 or 13 is that the diameter of the aperture 36 will be substantially the same as needed for inner surfaces 16 and 17 of auxiliary annular elements 12 and 13, respectively. If neither auxiliary annular elements 12 nor 13 is to be composed of tungsten carbide, the present invention method omits use of the step identified by reference numeral 42 and proceeds directly to the manufacturing step 43 for the removal of portions of the outer surface 38 of base ring blank 37.

Manufacturing step 43 of the present invention method reduces the diameter of cylindrical section 15 by removing a portion of the outer surface 38 of base ring blank 37. Using conventional machining or grinding apparatus, the portion of the base annular element 11 identified as cylindrical sector 15 is reduced in diameter from that of cylindrical sector 14 equivalent to the thickness of auxiliary annular elements 12 and/or 13. The distance between the surfaces of cylindrical sectors 14 and 15 will generally be equal to the thickness of auxiliary annular blanks 12 and 13. It is understood that the axial width of cylindrical sector 15 will determined by the number of auxiliary elements that are employed by the jewelry ring manufactured by the present invention method.

Figure 2:
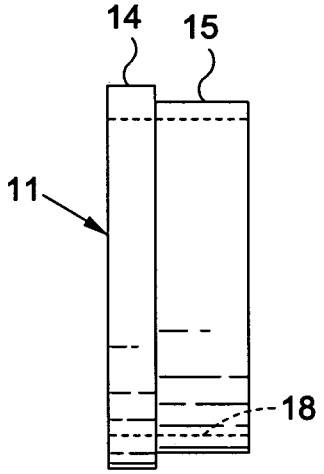
FIG. 2 is a front elevation view of the base annular element shown in FIG. 1.
Figure 3:
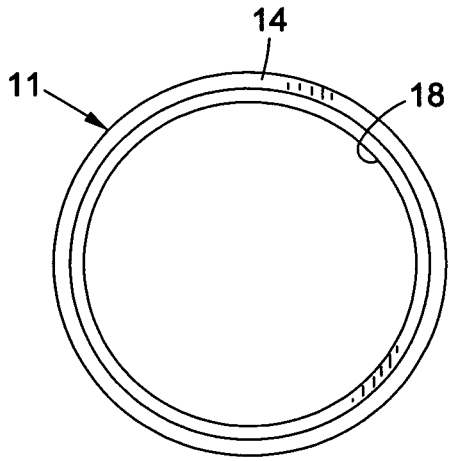
FIG. 3 is a side elevation view of the base annular element shown in FIG. 1.
Figure 4:
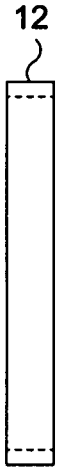
FIG. 4 is a front elevation view of an auxiliary annular element shown in FIG. 1.
Figure 5:
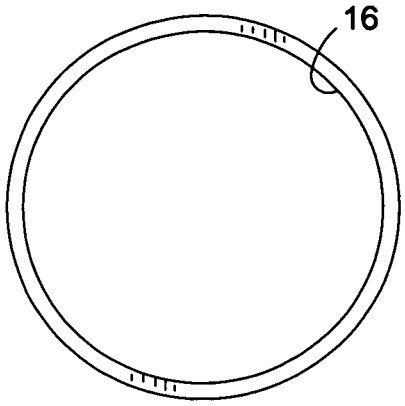
FIG. 5 is a side elevation view of an auxiliary annular element shown in FIG. 1.

The base annular element shown in FIG. 2 is a jewelry ring style that wherein the base annular element 11 is manufactured with cylindrical section 14 positioned at an axial margin of the element. One having skill in the art would understand that cylindrical section 14 could be positioned between the axial margins of the base annular element 11 and auxiliary annular elements positioned on either side. If this option is elected, manufacturing operation 43 is repeated.

The final step in the present invention method is manufacturing operation 44 which requires the finishing of base and auxiliary annular elements 11, 12 and 13 and their assembly into the final jewelry ring 10 shown in FIGS. 6 and 7. To assemble the form of the jewelry ring 10 shown in FIG. 1, auxiliary elements 12 and 13 are axially mounted upon cylindrical sector 15 and secured thereto by conventional adhesives.

As a result of the use of a manufacturing method in accordance with the present invention, multiple jewelry ring styles can be manufactured in whole or in part from tungsten carbide without the need to employ the restrictions imposed by the use of compression molds to form ring blanks. In addition, the use of auxiliary annular elements of difference materials enhances the ornamental appearance of the jewelry rings as a result of the ability to combine elements displaying differing textures and colors.

I claim:

1. A method for manufacturing multi-element tungsten carbide jewelry rings comprising the steps of:

(a) providing a planar plate having top and bottom surfaces composed of tungsten carbide;

(b) drilling a first cylindrical aperture through the plate having a circumferential surface perpendicular to the top and bottom surfaces of the plate, said first cylindrical aperture being adapted to receive a finger of a user;

(c) cutting a base annular blank from the plate about the cylindrical aperture, said base annular blank having a cylindrical outer surface and opposed axial surfaces in parallel spaced relation with each other, the cylindrical outer surface of the base annular blank circumscribing and being concentric with the surface of the first cylindrical aperture;

(d) drilling a second cylindrical aperture through the plate having a diameter that is greater than the diameter of the first cylindrical aperture;

(e) cutting of a first auxiliary annular blank from the plate about the second cylindrical aperture, said auxiliary annular blank having a cylindrical outer surface and opposed axial surfaces in parallel spaced relation with each other, the cylindrical outer surface of the auxiliary annular blank circumscribing and being concentric with the surface of the second cylindrical aperture;

(f) removing a uniform cylindrical segment axially from the cylindrical outer surface of the base annular blank forming a cylindrical receiving surface in the base annular blank that is concentric with the first cylindrical aperture, the diameter of said receiving cylindrical surface being substantially equal to the diameter of said second cylindrical aperture; and (g) mounting the auxiliary annular blank upon the receiving cylindrical surface of the base cylindrical blank whereby the surface of the second cylindrical aperture is adjacent the receiving cylindrical surface of the base annular blank.

2. A method for manufacturing multi-element tungsten carbide jewelry rings as defined in claim 1 wherein the step of drilling apertures through the planar plate composed of tungsten carbide is performed through the use of electrical discharge machining apparatus.

3. A method for manufacturing multi-element tungsten carbide jewelry rings as defined in claim 1 wherein the step of cutting annular blanks from the plate composed of tungsten carbide is performed through the use of wire electrical machining apparatus.

4. A method for manufacturing multi-element tungsten carbide jewelry rings as defined in claim 1 wherein the axial height of the cylindrical receiving surface is substantially equal to the axial height of the auxiliary annular blank between the opposed axial surfaces thereof.

5. A method for manufacturing multi-element tungsten carbide jewelry rings as defined in claim 1 including the steps of:

(a) drilling a third cylindrical aperture through the plate having a diameter that is greater than the diameter of the first cylindrical aperture;

(b) cutting an auxiliary annular blank from the plate about the third cylindrical aperture, said auxiliary blank having a cylindrical outer surface and opposed axial surface in parallel spaced relation to each other, the cylindrical outer surface of the auxiliary annular blank circumscribing and being concentric with the surface of the third cylindrical aperture; and (c) the axial height of the cylindrical receiving surface is substantially equal to the axial heights of the first and second auxiliary annular blanks between the opposed axial surfaces of each.

6. A method for manufacturing multi-element tungsten carbide jewelry rings as defined in claim 1 wherein the steps of drilling cylindrical apertures through the plate are performed by ram electrical discharge machining apparatus.

7. A method for manufacturing multi-element tungsten carbide jewelry rings as defined in claim 1 wherein the steps of cutting base and auxiliary annular blanks from the plate are performed by using wire electrical discharge machining apparatus.

* * * * *